US009183828B2

(12) United States Patent
Ng

(10) Patent No.: US 9,183,828 B2
(45) Date of Patent: Nov. 10, 2015

(54) NOISE CONTROL PANELS TO PROVIDE A NOISE-FREE ENVIRONMENT FOR INFANTS

(71) Applicant: Yuk King Monica Ng, Kowloon (HK)

(72) Inventor: Yuk King Monica Ng, Kowloon (HK)

( * ) Notice: Subject to any disclaimer, the term of this patent is extended or adjusted under 35 U.S.C. 154(b) by 54 days.

(21) Appl. No.: 14/223,962

(22) Filed: Mar. 24, 2014

(65) Prior Publication Data

US 2015/0269923 A1 Sep. 24, 2015

(51) Int. Cl.

| | |
|---|---|
| ***G10K 11/175*** | (2006.01) |
| ***A47D 9/00*** | (2006.01) |
| ***A47D 15/00*** | (2006.01) |

(52) U.S. Cl.

CPC ..... *G10K 11/175* (2013.01); *A47D 9/00* (2013.01); *A47D 15/00* (2013.01)

(58) Field of Classification Search

None

See application file for complete search history.

(56) References Cited

U.S. PATENT DOCUMENTS

| | | | | |
|---|---|---|---|---|
| 4,305,168 | A * | 12/1981 | Holter et al. | 5/512 |
| 6,409,654 | B1 * | 6/2002 | McClain | 600/22 |
| 2014/0003614 | A1 * | 1/2014 | Levitov et al. | 381/71.7 |

* cited by examiner

*Primary Examiner* — Paul Huber

(74) *Attorney, Agent, or Firm* — Matthew M. DiMaggio, Esq.

(57) ABSTRACT

According to embodiments of the invention, systems, methods and devices are directed to a noise control panel which serves as a sound barrier intended to provide a noise-free environment for infants. Various embodiments of the invention implement several novel features, including, in one embodiment, the noise control having a main body formed from a panel forming either a straight or curved upright sound barrier in front of a baby bed. Multiple panels may cover all sides of the bed and may have sound detectors incorporated therein. A vent serves to provide air circulation and/or conditioning if the panels are in a position enclosing the bed.

10 Claims, 5 Drawing Sheets

NOISE CONTROL PANELS TO PROVIDE A NOISE-FREE ENVIRONMENT FOR INFANTS

FIELD OF THE INVENTION

This invention generally relates to noise reduction. Specifically, this invention relates to reducing noise to help create a noise-free environment for babies.

BACKGROUND OF THE INVENTION

Baby products are in great demand because the birth rate has been increasing at a very high rate. Products targeting well-being of babies can be very profitable. Parents are constantly looking for new products to provide a more comfortable and healthy environment for babies.

It's well known that babies sleep best in environments that are free of sudden or startling noises. Therefore, if parents want their babies to sleep well, a decent environment is needed, as long as any necessary noise is low & steady. Even a short moment of sharp noise can wake up babies. Such would cause disruptions not only to babies but also parents. Surprisingly to many, babies are used to some noise. Since babies are used to the sounds of their mother's womb, many newborns refuse to sleep in perfect silence because it is too strange. Many parents would like to sleep well naturally. Currently, one common way for these parents to maintain a quite environment is to close all the doors and windows of their residence. The problem is that air circulation would be limited and could be harmful to the babies in a different way. As a result, an invention that can minimize random noise coming from outside the street, such as road noise, or disruptions from the neighbors, is desired.

SUMMARY OF THE INVENTION

According to embodiments of the invention, systems, methods and devices are directed to a noise control panel which serves as a sound barrier intended to provide a noise-free environment for infants. Various embodiments of the invention implement several novel features, including, in one embodiment, the noise control having a main body formed from a panel forming either a straight or curved upright sound barrier in front of a baby bed. Multiple panels may cover all sides of the bed and may have sound detectors incorporated therein. A vent serves to provide air circulation and/or conditioning if the panels are in a position enclosing the bed.

In an embodiment of the disclosed invention, abed is equipped with a plurality of noise detection devices capable of detecting direction and magnitude of noise to control angles of inclination of panels attached to the bed. The bed may have one or more of the following components: a) a bed frame with a first bedside, second bedside, third bedside, and a fourth bedside; b) a first sound detector attached to the first bedside facing a first direction configured to detect magnitude and direction of noise coming from the first direction; c) a second sound detector attached to the second bedside facing a second direction configured to detect magnitude and direction of noise from the second direction; d) a third sound detector attached to the third bedside facing a third direction configured to detect magnitude and direction of noise from the third direction; d) a fourth sound detector attached to the fourth bedside facing a fourth direction configured to detect magnitude and direction of noise from the fourth direction; e) a first rotatable panel hinged on the first bedside, wherein the first rotatable panel is rotatable along the first bedside and is fixable in an inclined position having a particular angle of inclination; f) a second rotatable panel hinged on the second bedside, wherein the second rotatable panel is rotatable along the second bedside and is fixable in an inclined position having a particular angle of inclination; g) a third rotatable panel hinged on the third bedside, wherein the third rotatable panel is rotatable along the third bedside and is fixable in an inclined position having a particular angle of inclination; h) a fourth rotatable panel hinged on the fourth bedside, wherein the fourth rotatable panel is rotatable along the fourth bedside and is fixable in an inclined position having a particular angle of inclination; i) an air-conditioned vent attached to each of the first, second, third, and fourth rotatable panels, wherein the air-conditioned vent increases airflow from an air conditioner when one of the rotatable panels is rotated to a position covering a portion of a top part of the bed, and ventilates the bed when one of the rotatable panels is rotated to a position covering the top part of the bed; j) a sound generator associated with the air-conditioned vent, wherein the sound generator produces destructive interference sound waves to offset incoming noise; and/or k) a processor attached to the frame, where the processor executes instructions stored in memory.

The instructions may be carried out, not necessarily in the following order, by: a) determining noise direction by calculating noise magnitude of the each of the directions detected by each of the first, second, third and fourth sound detectors; and b) toggling the first, second, third and/or fourth rotatable panels based on the steps of calculating noise magnitude.

In a further embodiment, no noise being detected, as indicated by zero magnitude of each of the first, second, third, and fourth sound detector, may cause the first, second, third, and fourth rotatable panels to be flipped down. Further, noise detected from the first direction having a medium noise magnitude may cause the first rotatable panel to be toggled to the inclined position.

In another embodiment of the disclosed technology, intense noise coming from the first direction causes: a) the first rotatable panel to be flipped up to completely cover the top part of the bed; and b) the air conditioner to ventilate the bed.

Still further, noise coming from each of the first, second, third, and fourth directions may cause flipping up of each of the first, second, third, and fourth rotatable panels to specific inclined angles to block noise from all directions. In a further step of this embodiment, the sound generator may be activated to: i) detect incoming sound waves; ii) calculate destructive interference sound waves so that the incoming sound waves can be offset; and iii) produce the destructive interference sound waves.

In further embodiments, the bed may have an alarm to alert parents when airtight conditions occur. Each of the first, second, third, and fourth rotatable panels may have a sound generator that can produce destructive interference sound waves to offset incoming noise.

In yet another embodiment, the bed may be rounded, and each of the first, second, third and fourth rotatable panels may have a curved surface that is slidable from one bedside to another depending on the direction of the noise. Each of the first, second, third and fourth sound detectors may be moveable on the curved surface of each respective rotatable panel depending on the direction of the noise.

In accordance with these and other objects which will become apparent hereinafter, the invention will now be described with particular reference to the drawings.

DETAILED DESCRIPTION

According to embodiments of the invention, systems, methods and devices are directed to a noise control panel which serves as a sound barrier intended to provide a noise-free environment for infants. Various embodiments of the invention implement several novel features, including, in one embodiment, the noise control having a main body formed from a panel forming either a straight or curved upright sound barrier in front of a baby bed. Multiple panels may cover all sides of the bed and may have sound detectors incorporated therein. A vent serves to provide air circulation and/or conditioning if the panels are in a position enclosing the bed.

Referring now to the figures, systems, methods and devices are provided for managing and controlling noise and ventilation in a bed or crib for a baby or infant. The term "bed" is used in the following specification to include any type of crib, cradle, or bed that may be used by an infant or baby for sleeping and/or resting.

Figure 1:
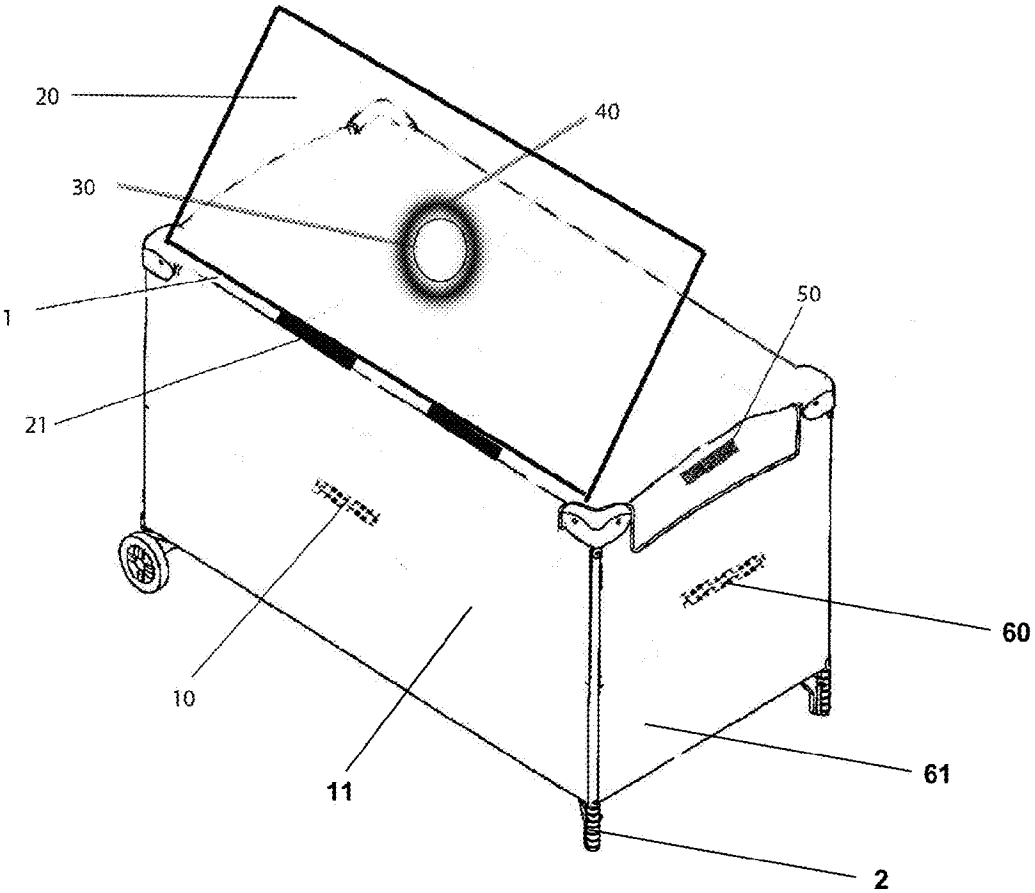
FIG. 1 is a perspective view of a bed according to an embodiment of the disclosed technology.

FIG. 1 is a perspective view of a bed according to an embodiment of the disclosed technology. The bed 1 has four sides, each side defined by a side panel. The bed 1 may have a frame or skeleton formed of rigid members. A first side panel 11 is shown having a first sound detector 10. A second side panel 61 is shown having a second sound detector 60. Third and fourth side panels (not shown) respectively have third and fourth sound detectors. The bed 1 may be supported, at least partially, by a set of wheels 2. A top panel 20 is depicted in an inclined or open position. The top panel 20 is rotatable on a hinge 21. The top panel 20 has an air-conditioned vent 40 formed by a cutout 30 in the top panel. A sound generator 50 is also disposed in a panel of the bed 1. Alternatively, multiple sound generators may be included on the bed, one associated with each sound detector.

Figure 2:
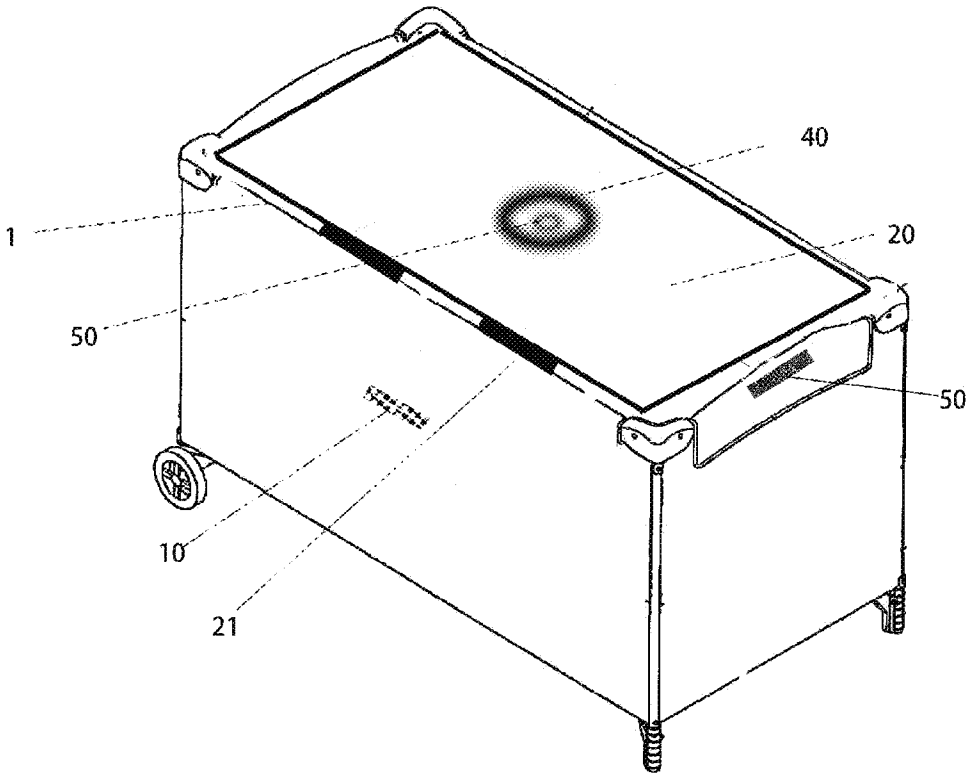
FIG. 2 shows the bed of FIG. 1 in a closed position.

FIG. 2 shows the bed of FIG. 1 in a closed position. Here, the top panel 20 has been lowered via the hinge 21. Likewise, a reduced-size cutout 50 is shown at the air-conditioned vent 40. A processor (not shown) may be attached to the bed 1. The processor may execute instructions stored in computer readable, non-transitory storage device (e.g. memory). The instructions may be carried out, not necessarily in the following order, by: a) determining noise direction by calculating noise magnitude of the each of the directions detected by each of the first, second, third and fourth sound detectors; and b) toggling the first, second, third and/or fourth rotatable panels based on the steps of calculating noise magnitude.

Figure 3:
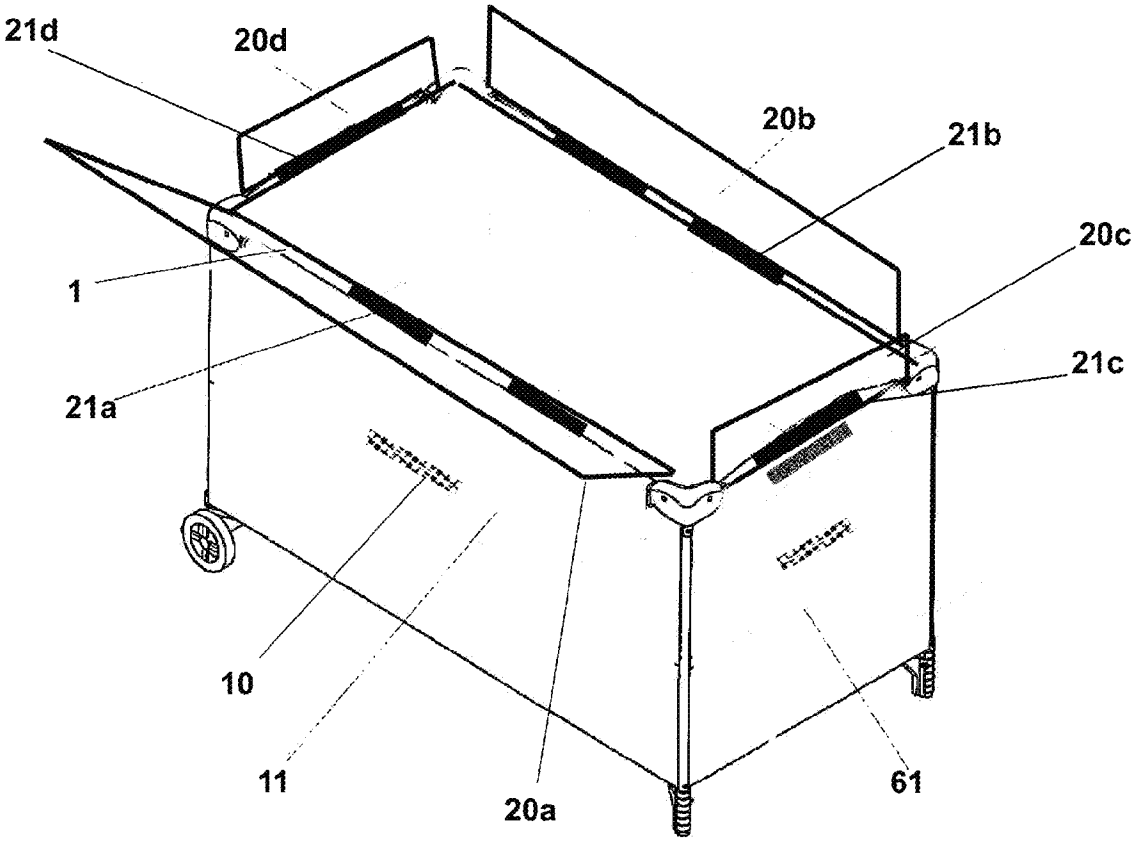
FIG. 3 is a perspective view of a bed with a partitioned top panel according to an embodiment of the disclosed technology.

FIG. 3 is a perspective view of a bed with a partitioned top panel according to an embodiment of the disclosed technology. In this embodiment, the top panel is partition into four parts or flaps 20*a-d*. Each flap has an associated hinge 21*a-d* on which the flap rotates. The flaps 20*a-d* may be selectively opened, closed and/or inclined depending on the environmental conditions surrounded the bed. The environmental conditions may include direction and magnitude of sound, as well as direction, magnitude and temperature of airflow. Likewise, the side panels may be similarly configured in that they may be portioned and/or rotatable to different positions of inclination.

Figure 4:
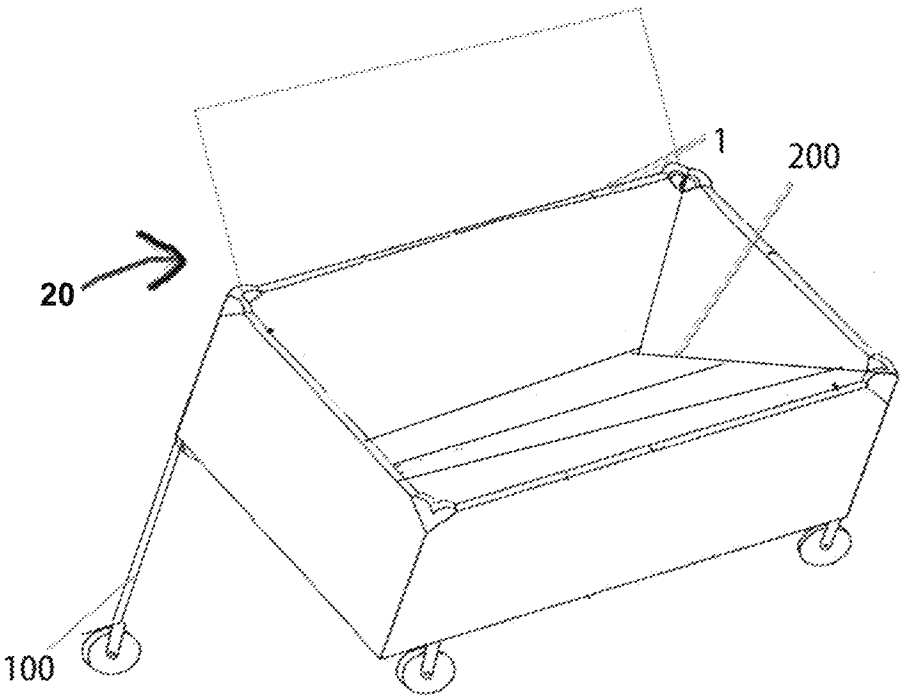
FIG. 4 is a perspective view of an inclined bed according to an embodiment of the disclosed technology.

FIG. 4 is a perspective view of an inclined bed according to an embodiment of the disclosed technology. In this embodiment, a rod 100 is extendable between a wheel 2 and the base of the bed 1 to cause the entire bed to be inclined or tilted in a given direction. Such may be the case when noise or airflow is concentrated at one side or angle with respect to the bed. In this embodiment, when the bed 1 is tilted, the surface 200 on which the infant in lying may also be inclined so that the infant is upright. The rod 100 may be disposed within the frame of the bed 1 when not in use, and may be extended in the context of certain environmental conditions.

Figure 5:
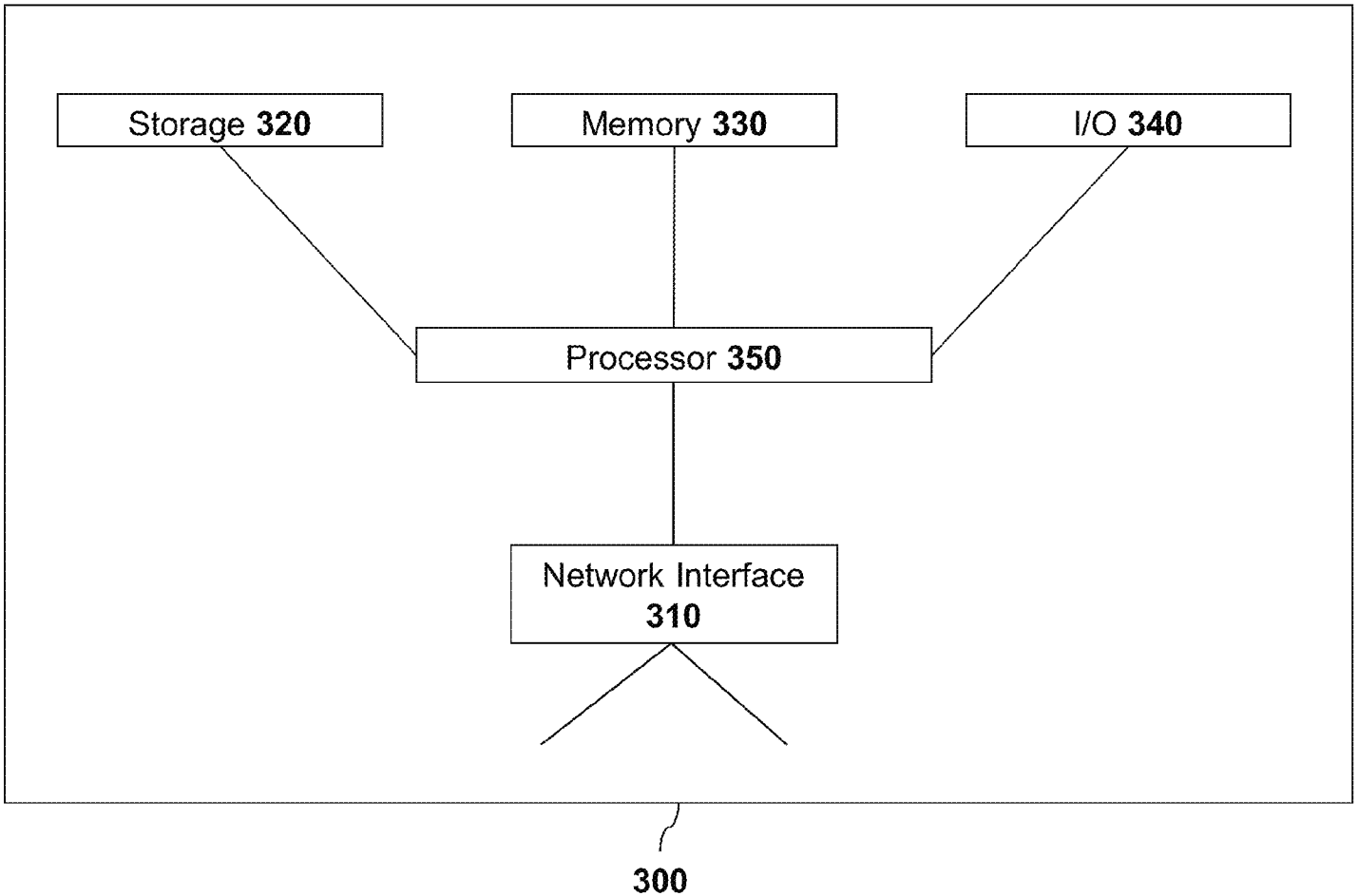
FIG. 5 is a high-level block diagram of a microprocessor device that may be used to carry out the disclosed technology.

FIG. 5 is a high-level block diagram of a microprocessor device that may be used to carry out the disclosed technology. The device 300 may or may not be a computing device. The device 300 comprises a processor 350 that controls the overall operation of a computer by executing the reader's program instructions which define such operation. The device's program instructions may be stored in a storage device 320 (e.g., magnetic disk, database) and loaded into memory 330 when execution of the console's program instructions is desired. Thus, the device's operation will be defined by its program instructions stored in memory 330 and/or storage 320, and the console will be controlled by the processor 350 executing the console's program instructions.

The device 300 may also include one or a plurality of input network interfaces for communicating with other devices via a network (e.g., the internet). The device 300 further includes an electrical input interface for receiving power and data from a power or RFID source. The device 300 may also include one or more output network interfaces 310 for communicating with other devices. The device 300 may also include input/output 340 representing devices which allow for user interaction with a computer (e.g., display, keyboard, mouse, speakers, buttons, etc.).

One skilled in the art will recognize that an implementation of an actual device will contain other components as well, and that FIG. 5 is a high level representation of some of the components of such a device for illustrative purposes. It should also be understood by one skilled in the art that the devices depicted and described with respect to FIGS. 1 through 4 may be implemented on a device such as is shown in FIG. 5.

While the disclosed invention has been taught with specific reference to the above embodiments, a person having ordinary skill in the art will recognize that changes can be made in form and detail without departing from the spirit and the scope of the invention. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

The invention claimed is:

1. A bed equipped with a plurality of noise detection devices capable of detecting direction and magnitude of noise to control angles of inclination of panels attached to the bed, the bed comprising:

a bed frame with a first bedside, second bedside, third bedside, and a fourth bedside;

a first sound detector attached to the first bedside facing a first direction configured to detect magnitude and direction of noise coming from the first direction;

a second sound detector attached to the second bedside facing a second direction configured to detect magnitude and direction of noise from the second direction;

a third sound detector attached to the third bedside facing a third direction configured to detect magnitude and direction of noise from the third direction;

a fourth sound detector attached to the fourth bedside facing a fourth direction configured to detect magnitude and direction of noise from the fourth direction;

a first rotatable panel hinged on the first bedside, wherein the first rotatable panel is rotatable along the first bedside and is fixable in an inclined position having a particular angle of inclination;

a second rotatable panel hinged on the second bedside, wherein the second rotatable panel is rotatable along the second bedside and is fixable in an inclined position having a particular angle of inclination;

a third rotatable panel hinged on the third bedside, wherein the third rotatable panel is rotatable along the third bedside and is fixable in an inclined position having a particular angle of inclination;

a fourth rotatable panel hinged on the fourth bedside, wherein the fourth rotatable panel is rotatable along the fourth bedside and is fixable in an inclined position having a particular angle of inclination;

an air-conditioned vent attached to each of the first, second, third, and fourth rotatable panels, wherein the air-conditioned vent increases airflow from an air conditioner when one of the rotatable panels is rotated to a position covering a portion of a top part of the bed, and ventilates the bed when one of the rotatable panels is rotated to a position covering the top part of the bed;

a sound generator associated with the air-conditioned vent, wherein the sound generator produces destructive interference sound waves to offset incoming noise;

a processor attached to the frame, where the processor executes instructions stored in memory, the instructions comprising:

determining noise direction by:

calculating noise magnitude of the first direction detected by the first sound detector;

calculating noise magnitude of the second direction detected by the second sound detector;

calculating noise magnitude of the third direction detected by the third sound detector; and calculating noise magnitude of the fourth direction detected by the fourth sound detector; and toggling the first, second, third and/or fourth rotatable panels based on the steps of calculating noise magnitude.

2. The bed of claim 1, wherein no noise being detected, as indicated by zero magnitude of each of the first, second, third, and fourth sound detector, causes the first, second, third, and fourth rotatable panels to be flipped down.

3. The bed of claim 1, wherein noise detected from the first direction having a medium noise magnitude causes the first rotatable panel to be toggled to the inclined position.

4. The bed of claim 1, wherein intense noise coming from the first direction causes:

the first rotatable panel to be flipped up to completely cover the top part of the bed; and the air conditioner to ventilate the bed.

5. The bed of claim 1, wherein noise coming from each of the first, second, third, and fourth directions, causes flipping up of each of the first, second, third, and fourth rotatable panels to specific inclined angles to block noise from all directions.

6. The bed of claim 1, wherein noise coming from each of the first, second, third, and fourth directions, causes:

flipping up of all of the first, second, third, and fourth rotatable panels to an upright position to block noise from all directions; and activating of the sound generator to: i) detect incoming sound waves; ii) calculate destructive interference sound waves so that the incoming sound waves can be offset; and iii) produce the destructive interference sound waves.

7. The bed of claim 1, further comprising an alarm to alert parents when airtight conditions occur.

8. The bed of claim 1, wherein each of the first, second, third, and fourth rotatable panels has a sound generator that produces destructive interference sound waves to offset incoming noise.

9. The bed of claim 1, wherein the bed is rounded, and each of the first, second, third and fourth rotatable panels has a curved surface and is slidable from one bedside to another depending on the direction of the noise.

10. The bed of claim 9, wherein each of the first, second, third and fourth sound detectors are moveable on the curved surface of each respective rotatable panel depending on the direction of the noise.

* * * * *